United States Patent [19]

Savenije

[11] Patent Number: 4,847,995

[45] Date of Patent: Jul. 18, 1989

[54] SHAVING APPARATUS

[75] Inventor: Eustachius P. W. Savenije, Eindhoven, Netherlands

[73] Assignee: U.S. Philips Corp., New York, N.Y.

[21] Appl. No.: 128,758

[22] Filed: Dec. 4, 1987

[30] Foreign Application Priority Data

Dec. 12, 1986 [NL] Netherlands ..... 8603166

[51] Int. Cl.[4] ..... B26B 19/42

[52] U.S. Cl. ..... 30/34.2; 30/43.3

[58] Field of Search ..... 30/34.2, 43, 43.3, 42, 30/45, 217–219

[56] References Cited

U.S. PATENT DOCUMENTS 4,174,569 11/1979 Schenk et al. ..... 30/43.3

*Primary Examiner*—Douglas D. Watts

*Attorney, Agent, or Firm*—Ernestine C. Bartlett

[57] ABSTRACT

A shaving apparatus comprising a cutting member and an opposite member which has a hair-seizing end and can be driven with respect to the cutting member with a relative movement. The plate-shaped opposite member is coupled to a driving mechanism via a rod mechanism.

4 Claims, 2 Drawing Sheets

SHAVING APPARATUS

FIELD OF THE INVENTION

The invention relates to a shaving apparatus comprising a cutting member and an opposite member which has a hair-seizing end and can be driven with respect to the cutting member.

BACKGROUND OF THE INVENTION

Such a shaving apparatus is known, for example, from U.S. Pat. No. 2,120,009. In this shaving apparatus the opposite member is formed by a rotatably drivable cylinder having spiral-like extending grooves. During operation of the apparatus the skin to be shaved engages a part of the circumference of the cylinder. The danger exists that as a result of the friction the skin is taken along by the cylinder and is urged against the cutting member so that injuries may be the result.

SUMMARY OF THE INVENTION

It is the object of the invention to avoid this disadvantage. To this end, the invention is a shaving apparatus comprising a cutting member and an opposite member which has a hair-seizing end and can be driven with respect to the cutting member characterized in that the plate-shaped opposite member is coupled to a driving mechanism, via a rod mechanism.

In a preferred embodiment, the opposite member comprises a skin-pressing member a pressure end of which is situated near the hair-seizing end and which skin pressing member is pivotably connected to the opposite member. In an especially preferred embodiment, a resilient element is present between the opposite member and the skin-pressing member.

The invention will now be described in greater detail with reference to a description of a few embodiments shown in the Figures.

DETAILED DESCRIPTION OF PREFERRED EMBODIMENTS

Figure 1:
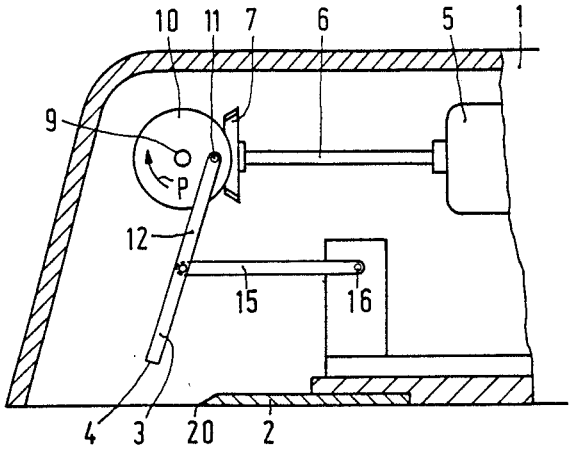
FIG. 1 shows, partly as a longitudinal sectional view, a shaving apparatus according to the invention.
Figure 2:
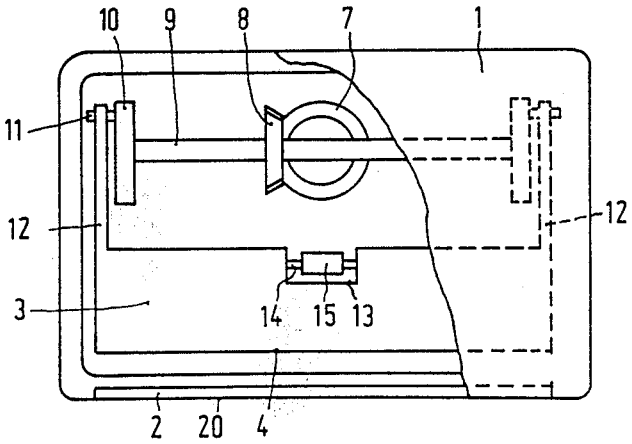
FIG. 2 is a front elevation of the apparatus of FIG. 1 in which the housing has been partly broken away.
Figure 3:
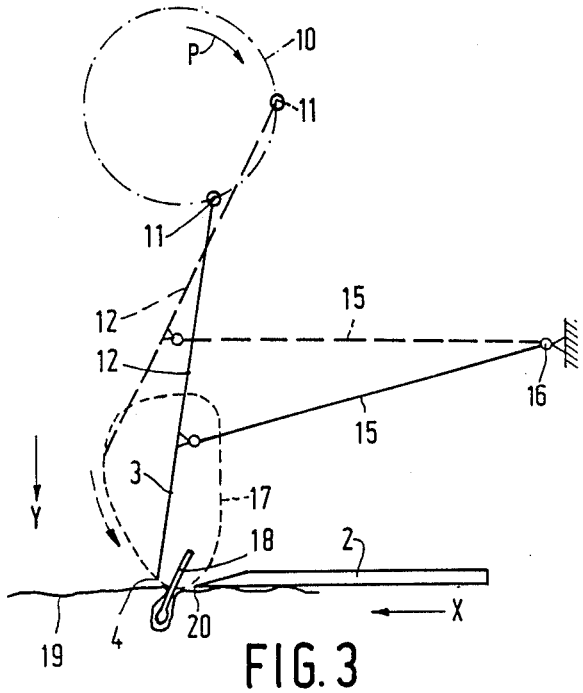
FIG. 3 shows diagrammatically the operation of the apparatus shown in FIGS. 1 and 2.

The apparatus shown in FIGS. 1 to 3 comprises a housing 1 having a rigid cutting member 2 and an opposite member 3 which has a hair-seizing end 4 and can be driven with respect to the cutting member 2. The housing 1 also comprises the driving mechanism which comprises a motor 5 which is coupled to the shaft 9 via the motor shaft 6 and the conical gears 7 and 8. The shaft 9 is journalled in the housing 1 so as to be rotatable. On the ends of the shaft 9 are present the discs 10 with the studs 11 on which the ends of the arms 12 are journalled so as to be rotatable. The arms 12 constitute one assembly with a plate-shaped opposite member 3. A pin 14 is provided in a recess 13 of the opposite member 3. One end of a connection arm 15 is journalled on the pin 14 so as to be rotatable and the other end is journalled so as to be rotatable about a pin 16 which is rigidly connected to the housing 1.

When the shaft 9 and hence the discs 10 are rotatably driven in the direction of the arrow P by the motor 5 the end 4 of the opposite member 3 will follow a closed path 17 per revolution of the shaft 9 as is shown by a broken line in FIG. 3. As a result of this a hair 18 which projects from the skin 19 to be shaved may be pressed against the cutting edge 20 of the cutting member 2 by the end 4 as a result of which the hair 18 is cut. Said cutting is still promoted in that the shaving apparatus is moved over the skin 19 in the direction X parallel to the cutting member 2.

Because the cutting member directly engages the skin 19 a maximum part of the hair 18 is cut. As a result of the operation of the opposite member 3 the hair 18 cannot deflect during cutting so that a better cut is formed and the shaving result is improved.

The path 17 depends inter alia on the length of the connection arm 15 and the place of the pins 14 and 16 and will preferably be chosen to be so that the end 4 approaches the skin 19 substantially in a direction Y which is perpendicular to the direction of X. The end 4, having arrived near the skin 19 and within reach of the hair 18, will preferably move towards the cutting member 2 substantially in a direction opposite to X.

As a result of this driving of the opposite member 3 by means of a rod mechanism formed by the arms 12 and the connection arm 15, the end 4 describes a path in which said end is not in contact with the skin or only for a very short time, that is to say, during a fraction of the time in which the path 17 is covered. Moreover, because the opposite member is in the form of a plate, the optional contact area with the skin is small. As a result of this the possibility that the skin is squeezed between the cutting member 2 and the opposite member 3 is considerably reduced.

Figure 4:
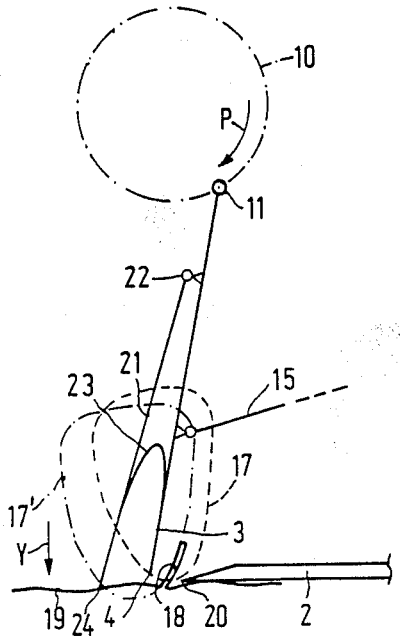
FIGS. 4 and 5 show diagrammatically a modified embodiment of the apparatus of FIGS. 1 to 3.
Figure 5:
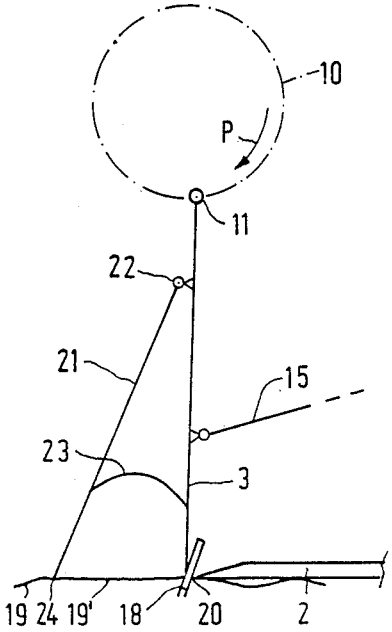

FIGS. 4 and 5 show diagrammatically, in accordance with FIG. 3, an embodiment in which the opposite member 3 comprises a pushing member 21. Otherwise the apparatus is equal to that of FIGS. 1 to 3. The pushing member 21 is also in the form of a plate and its dimensions and shape are approximately equal to those of the opposite member 3. One end of the pushing member 21 is coupled in the pivot 22 to the opposite member 3 so as to be rotatable. A spring 23, for example a bent leaf spring, is provided between the opposite member 3 and the pushing member 21. The end 24 of the pushing member 21 in the Y-direction, perpendicularly to the X-direction, slightly leads with respect to the end 4 and will describe a substantially equal path 17' (FIG. 4). At the instant the end 24 touches the skin 19, said end will temporarily move no longer with respect to the skin while the end 4 continues the path 17. As a result of this the end 24 will slightly push away the skin and will stretch the part of the skin 19' (FIG. 5) between the end 24 and the cutting side 20. As a result of this the hair 18 will slightly project further beyond the skin 19 and will lift up so that the shaving result is even improved. Moreover, the possibility that the cutting member 2 cuts the skin is still further reduced considerably.

What is claimed is:

1. A shaving apparatus comprising a housing, a cutting member and a plate-shaped opposite member which has a hair-seizing end and can be driven with respect to the cutting member wherein the plate-shaped opposite member is coupled to a driving mechanism via a rod mechanism, the opposite member being pivotally connected to a skin pressing member a pressure end of which is situated near the hair-seizing end.

2. A shaving apparatus as claimed in claim 1 wherein a resilient element is present between the opposite member and the skin pressing member.

3. A shaving apparatus as claimed in claim 1 wherein the opposite member follows a predetermined closed path in which the hair-seizing end approaches skin to be shaven in a direction which is perpendicular to a direction parallel to the cutting member.

4. A shaving apparatus as claimed in claim 3 wherein the rod mechanism comprises a shaft journalled in the housing so as to be rotatable, the ends of the shaft bearing discs with studs on which the ends of an arm is journalled, the arm having at its end the plate-shaped opposite member having a first pin provided in a recess thereof, said first pin having a first end of a connection arm journalled thereon, a second end of said connection arm being journalled so as to be rotatable about a second pin which is rigidly connected to the housing.

* * * * *